United States Patent [19]

Benedicenti

[11] Patent Number: 4,746,321

[45] Date of Patent: May 24, 1988

[54] AUTOMATIC MACHINE FOR FORMING BOXES OF THE DOUBLE-PLINTH TYPE

[75] Inventor: Pio G. Benedicenti, Chieri, Italy

[73] Assignee: Cartotecnica Chierese S.p.A., Chieri, Italy

[21] Appl. No.: 937,162

[22] Filed: Dec. 2, 1986

[30] Foreign Application Priority Data

Jun. 24, 1986 [IT] Italy ..... 67508 A/86

[51] Int. Cl.[4] ..... B31B 1/00

[52] U.S. Cl. ..... 493/14; 493/13; 493/112; 493/124; 493/125; 493/141; 493/151; 493/164

[58] Field of Search ..... 493/10–13, 493/110, 112, 120, 124–126, 131, 141, 147, 164, 89, 95, 100, 151, 906–908, 968, 14

[56] References Cited

U.S. PATENT DOCUMENTS

| | | | |
|---|---|---|---|
| 1,693,136 | 11/1928 | Carle | 493/110 |
| 2,240,445 | 4/1941 | Thaxton | 493/151 |
| 2,993,419 | 7/1961 | Currie | 493/126 |

*Primary Examiner*—Frederick R. Schmidt
*Assistant Examiner*—Robert Showalter
*Attorney, Agent, or Firm*—Sughrue, Mion, Zinn, Macpeak, and Seas

[57] ABSTRACT

A machine for forming cardboard boxes of the double-plinth type provides for the supply to the machine of flat punched sheets, already partially glued, intended to constitute the bottom, the side walls and the hinged lid with a first attached plinth of the box, in parallel with the supply of auxiliary punched sheets for defining, after gluing to the bottom of the box, the second plinth of the box itself. The machine forms the box and automatically glues the auxiliary punched sheets to the box itself.

9 Claims, 6 Drawing Sheets

AUTOMATIC MACHINE FOR FORMING BOXES OF THE DOUBLE-PLINTH TYPE

DESCRIPTION

The present invention relates to an automatic machine for forming boxes having a bottom, a lid opposite the bottom and hinged thereto, and side walls extending between the bottom and the lid, includining a cross-shaped rotor rotatably about a horizontal axis and carrying four forming heads provided with suction members and movable successively, as a result of the rotation of the rotor, between an upper station for the supply of punched sheets and the application of a liquid glue to predetermined zones of the sheets, a front station for forming the containers by cooperation of the heads with an erection mould, a lower waiting station, and a rear station for discharge of the boxes.

Such machines, as made at present, cannot be used for the manufacture of so-called double-plinth boxes. By a double-plinth box is meant a box having a bottom and a lid opposite the bottom which have peripheral edges projecting from the walls of the box. Double-plinth boxes are used particularly when it is wished to give the package products, for example chocolates or the like, a particular appearance.

At present, such boxes are formed manually or with the use of very complicated and expensive machines which carry out all the foming and gluing steps necessary to obtian the finished box from punched sheets.

The object of the present invention is to provide a machine of the type indicated a the beginning of the specification which is simple and cheap to manufacture and enables double-plinth boxes to be made in a particularly quick production cycle.

This object is achieved by virtue of the fact that the supply station of the machine is intended to receive punched sheets shaped so as to define the bottom, the side walls, the lid and a first plinth associated with the lid, ad in that it further includes a store for the supply of auxiliary sheets for constituting a second plinth of the box associated with the bottom of the latter, and actuator means for taking an auxiliary sheet selectively from the store, applying a predetermined quantity of liquid glue to one face thereof, and subsequently bringing the auxiliary sheet into contact with the bottom of a formed box carried by one of the forming heads at the lower waiting station in order to join them by gluing.

By virture of these characteristics, starting from two separate punched sheets of cardboard already partially finished and glued, it is possible to form a double-plinth box simply and quickly. This is particularly advantageous whenever the punched sheets are to be dispatched to a user having the machine according to the invention and where the boxes are to be formed in parallel with the packaging of the product.

Preferably, the actuator means comprise: stepwise conveyor means located beneath the rotor, between the store disposed in front of the machine and the lower waiting station of the rotor; take-up means located beneath the store and provided with suction members for taking an auxiliary sheet selectively from the store and transferring it to the conveyor means; liquid glue supply means associated with the conveyor means and arranged to deposit the glue on the auxiliary sheet, and lifting means disposed below the lower waiting station of the rotor and arranged to take up the auxliary sheet from the conveyor means and bring it into contact with the bottom of the formed box carried by the forming head.

Further advantages and characteristics of the machine according to the invention will become clear from the detailed description which follows, provided purely by way of non-limiting example, with reference to the appended drawings in which.

Figure 1:
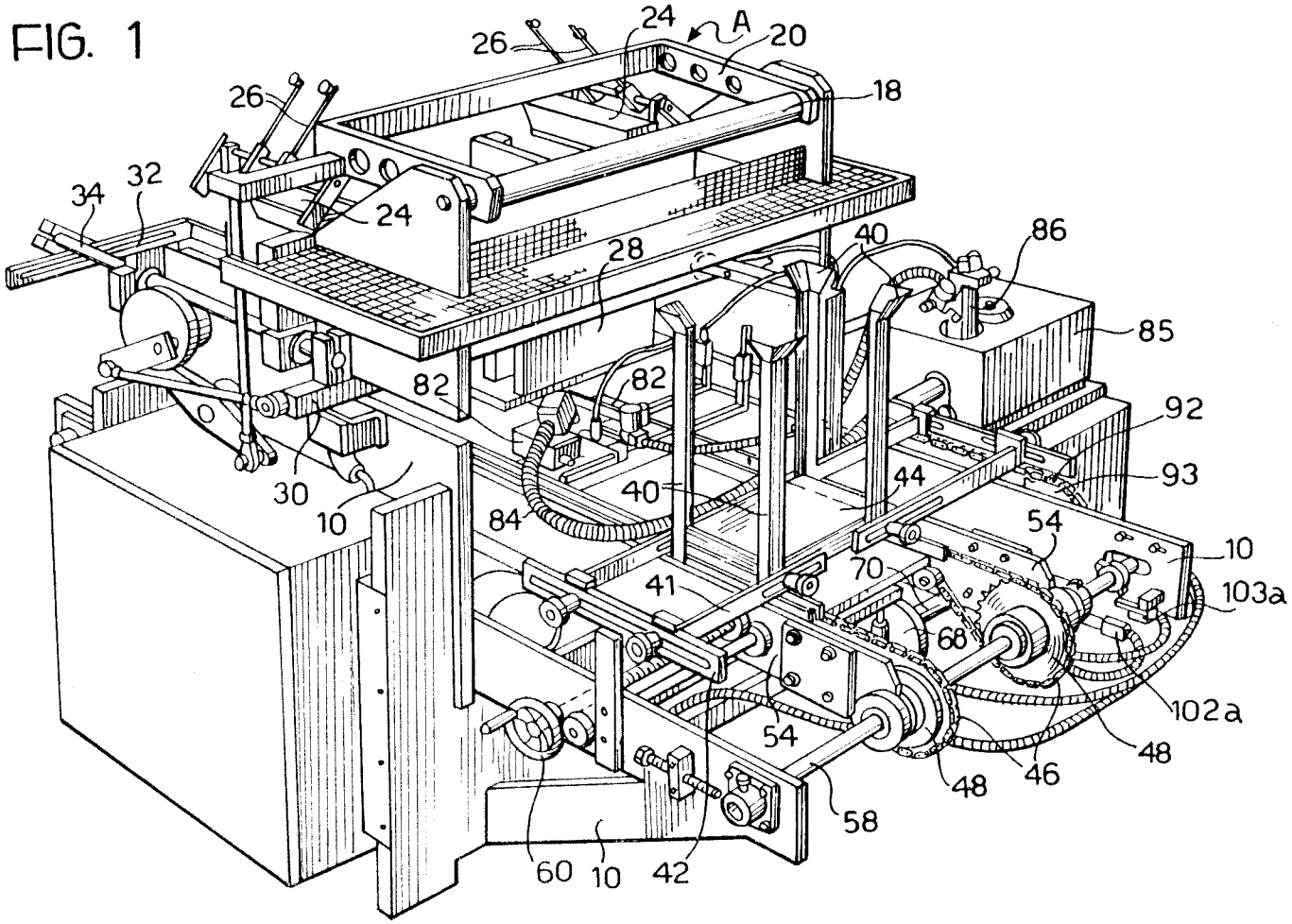
FIG. 1 is a front perspective view of the machine.
Figure 2:
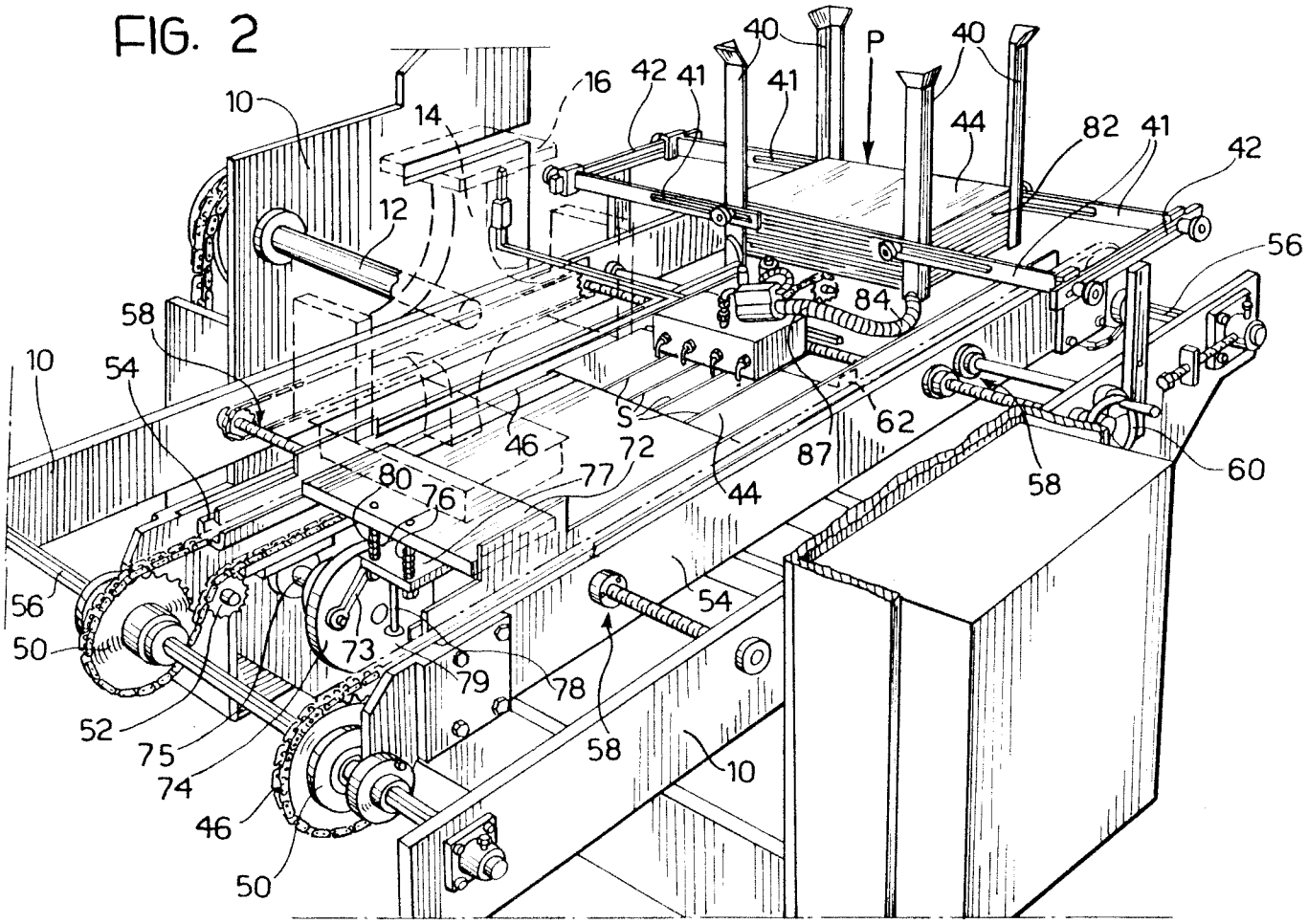
FIG. 2 is a partially-sectioned, rear perspective view of the machine.
Figure 3:
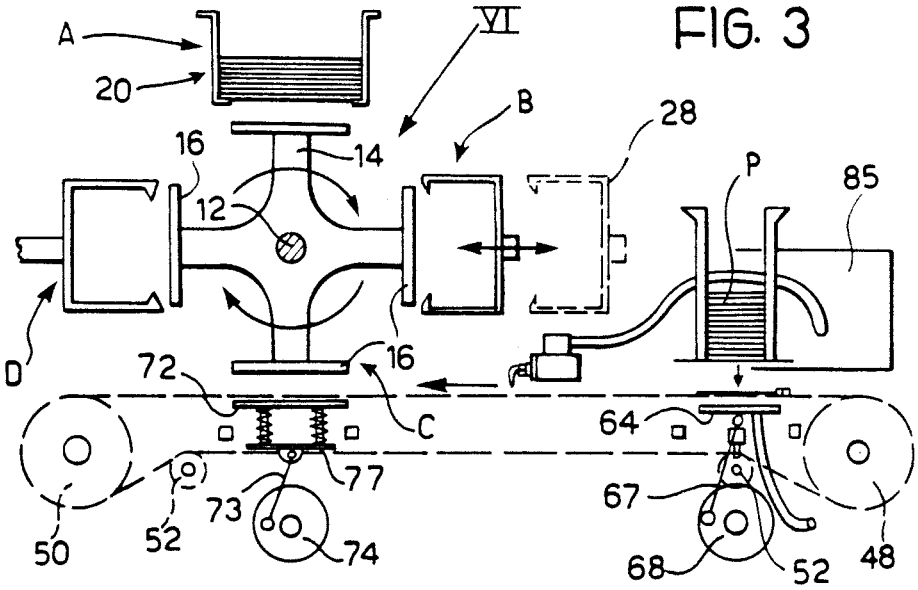
FIG. 3 is a schematic side view illustrating the operation of the machine.
Figure 6:
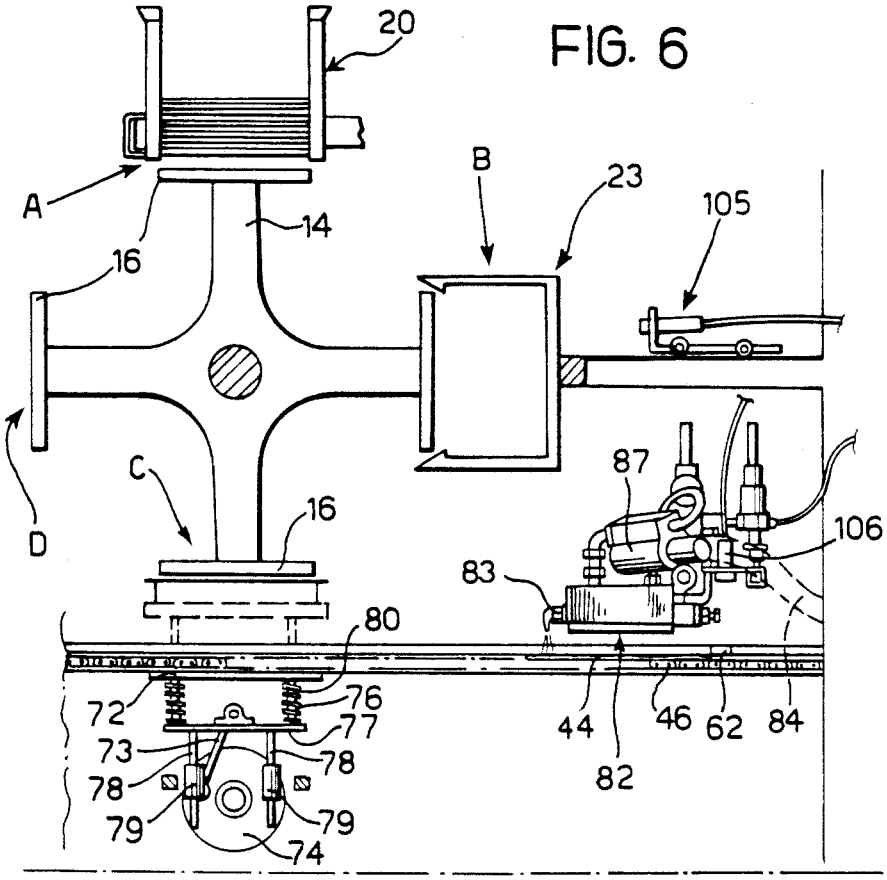
Figure 4:
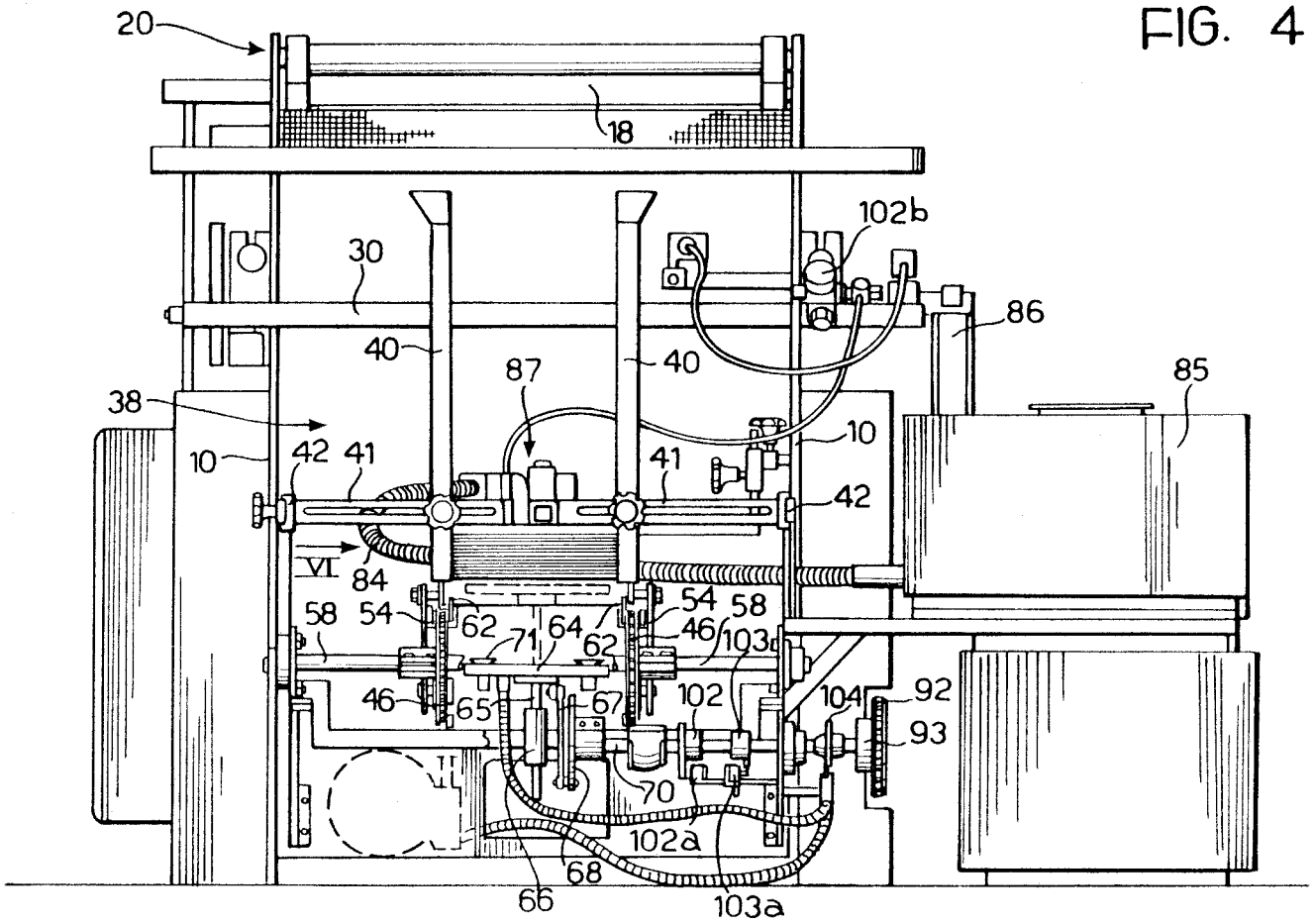
FIG. 4 is a view taken on the arrow IV of FIG. 1.
Figure 5:
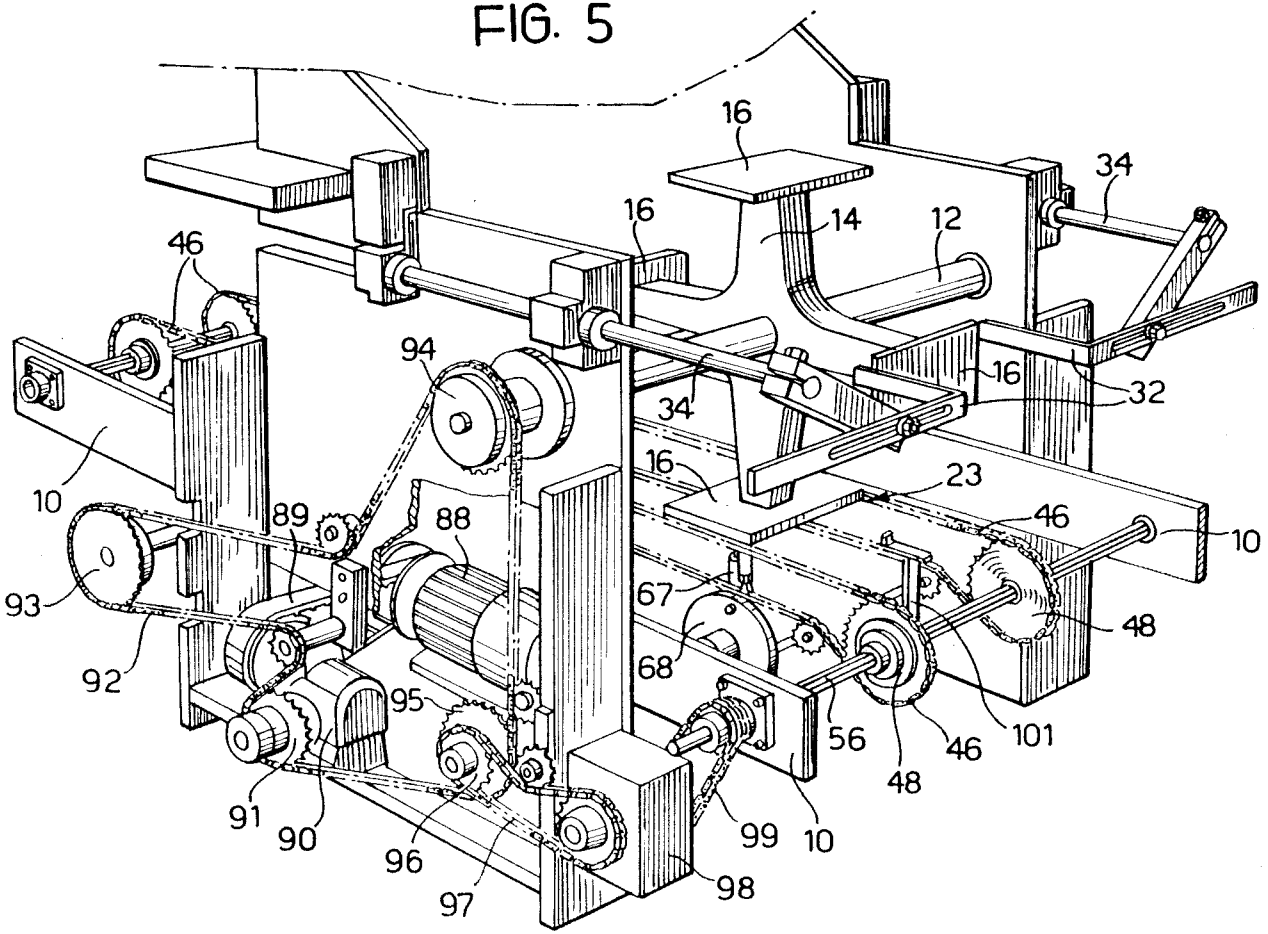
Figure 7:
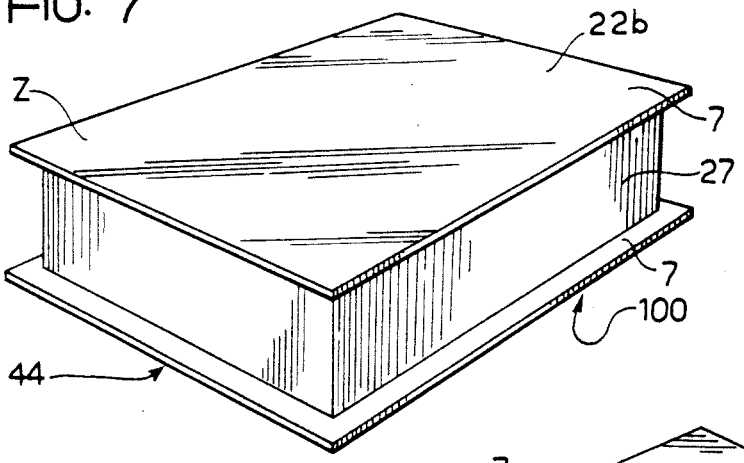
Figure 8:
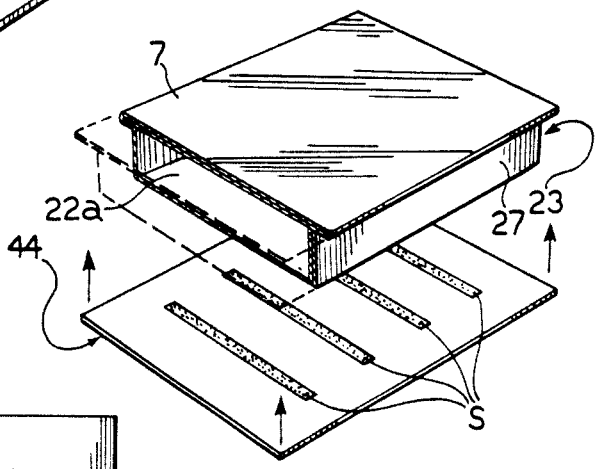
Figure 9:
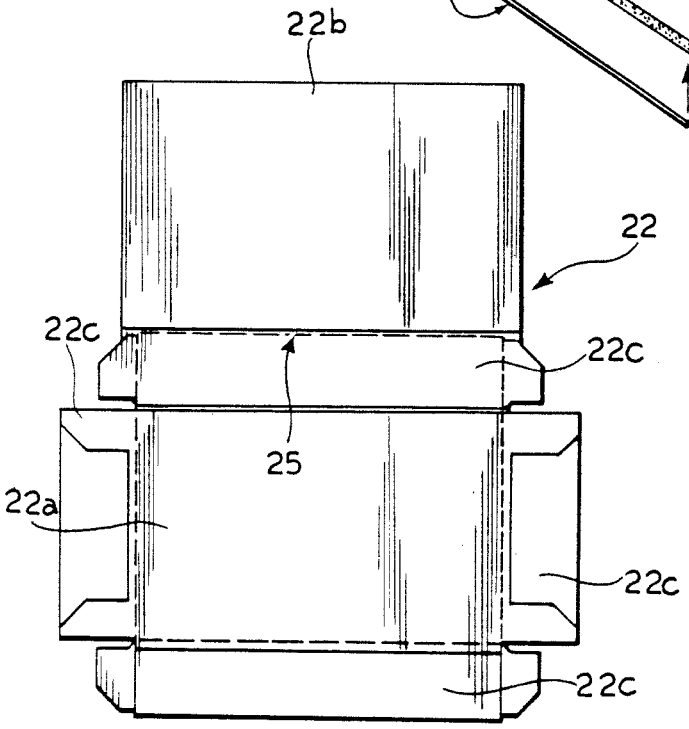

FIG. 5 is a rear perspective view illustrating the drive transmission members of the machine, FIG. 6 is partial view taken on the arrow VI of FIG. 4, FIG. 7 is a perspective view of the box made by the machine of FIG. 1, FIG. 8 is a partially-sectioned, exploded perspective view of the box of FIG. 7, and FIG. 9 is a plan view of the partially-glued sheet of punched cardboard used to manufacture the box of FIG. 7.

With reference to the drawings, the support structure of a forming machine according to the present invention is indicated 10.

A cross-shaped rotor 14 having four identical forming heads 16 is supported by the structure 10 for rotation about a horizontal shaft 12. A pivotable frame 20 is articulated to the upper part of the structure 10 about a horizontal pin 18 and supports in use a pile of partially-glued punched sheets 22 of cardboard (FIG. 9). Lateral dishes 24 containing heat-fusible glue are also fixed to the structure 10 and have associated pivotable arms 26 for applying the glue to several parts of the punched sheets 22.

The frame 20, with its dishes 24, defines a supply station, generally indicated A.

An erection mould 28 is slidably supported on the structure 10 by a support bar 30 and defines a forming station, generally indicated B.

In a position diametrally opposite the supply station A relative to the rotor 14 is a lower waiting station C whose use will be explained in the description below.

Extractors 32 for removing the formed boxes are provided at the rear of the machine and are operated by bars 34 slidable perpendicular to the horizontal shaft 12 of the rotor 14. The extractors 32 define a discharge station D.

The machine described so far, for the sake of completeness, is known and similar to that made and sold by the German company Schubert under the name SKA, so its operation will be indicated only briefly.

When one of the forming head 16 is at the upper station A with the rotor 14 stopped, the pivotable frame 20 is pivoted downwardly about the pin 18. At the same time, the pivotable arms 26 are operated so as to deposit a layer of liquid glue on suitable regions of the punched cardboard sheet 22.

At the lower position of the pivotable frame 20, one of the punched sheets 22 is in contact with the forming head 16 in the upper station and adheres thereto because of the suction members (not illustrated) located in the head 16. The pivotable frame 20 is then returned to its upper position and the head 16 with the punched sheet 22 rotates through 90° until it comes into correspondence with the front forming station B where the erection mould 28 is moved horizontally by the support bar 30 so as to couple with the head 16 and thus form the container. Subsequently, the rotor 14 rotates through a further 90°, carrying the container to the lower waiting station C.

The next rotation of the rotor 14 through 90° brings the box into correspondence with the rear station D where the extractors 32 operate to remove the box from the head 16, making it fall, for example, onto a suitable conveyor belt which conveys it to subsequent packaging stages.

It should be noted that, when the machine is limited as described above, the supply of the punched sheets 22 to the machine would produce a box of the type indicated 23 in FIG. 8, that is, a box with a single plinth. In fact, the punched sheet 22 has a rectangular portion **22*a* for consituting the bottom of the box and a rectangular portion 22*b* for constituting the lid, which is articulated to the box at 25 and has a slightly larger surface area than the surface of the rectangular base portion 22*a* so as to define an edge Z projecting beyond the walls 27 of the box 23. The walls 27 are constituted by portions 22*c* of the punched sheet 22 and the portion 22*b* of the punched sheet 22** is formed by a portion of the sheet which has previously been folded and glued.

In front of the machine and supported by the structure 10 is an auxiliary store 38 constituted by vertically-disposed angle sections 40 the mutual spacing of which can be adjusted by means of transverse guides 41 and longitudinal gudies 42. During operation of the machine, the auxiliary store 38 is intended to contain a pile P of auxiliary punched sheet 44 (FIG. 8) held from beneath by suitable stop teeth (not illustrated) formed at the base of the angle sections 40.

Below the rotor 14 is a pair of endless chains 46 which pass over respective toothed pulleys 48, 50 and are kept under tension by tensioning pulleys 52. The toothed pulleys 48, 50 of each chain 46 are supported by the ends of a respective support and guide bar 54 fixed to the structure 10 of the machine. Moreover, the pulleys 50 are fitted slidably onto a drive shaft 56, while the pulleys 48 are freely rotatable and slidable transversely on a guide shaft 58. The mutual spacing of the chains 46 may be varied by screw-and-nut devices 58 interposed between the structure 10 of the machine and the bars 54 themselves, these devices being operable manually by means of a wheel 60.

The chains 46 also have engagement teeth 62 facing each other, the function of which will be explained in the description below.

Beneath the auxiliary store 38 is a first horizontal plate 64 which is interposed between the chains 46 and has vertical guide rods 65 slidable in bushes 66 fixed to the structure 10 of the machine. The plate 64 is connected by a connecting rod 67 to a crank 68 fixed to a drive shaft 70 supported by the structure 10 of the machine. The plate 64 also has suction members 71 and can reciprocate between a first position substantially in correspondence with the bottom of the pile P of auxiliary sheets 44 and a second position beneath the upper passes of the chains 46.

A second plate 72 is interposed between the chains 46 at the lower waiting station C and is connected to a connecting rod 73 and a crank 74 fixed to a drive shaft 75. The plate 72 has four auxiliary rods 76 slidable in suitable apertures in an auxiliary plate 77 provided in its turn with vertical rods 78 slidable in bushes 79 supported by the structure 10 of the machine. Helical springs 80 for biassing the plates 72 and 77 resiliently away from each other are located coaxially with the auxiliary rods 76, between the auxiliary plate 77 and the plate 72.

Like the first plate 64, the second plate 72 can reciprocate vertically between a first upper position in contact with one of the forming heads 16 at the position C and a lower position substantially beneath the plane defined by the upper passes of the chains 46. The helical springs 80 provide damped contact between the plate 72 and its formig head 16 which, during rotation of the crank 74, is able to extend the contact.

Between the rotor 14 and the auxiliary store 38 and above the horizontal plane defined by the upper passes of the parallel chains 46 is a head 82 for supplying heat-fusible glue. The head 82 has supply nozzles 83 which face substantially downwardly and are adjustable with regard to the directions of the jets. The head 82 has internal heaters for keeping the heat-fusible glue fluid, and is connected by a heated tube 84 to a thermostatically-controlled reservoir 85 which has an associated single-acting pneumatc piston 86 for delivering a dose of glue to the head 82. The nozzles 83 have an associated pneumatic solenoid valve 87 for controllling shutters (not illustrated) with which the nozzles themselves are provided.

FIG. 5 illustrates the drive transmission to the various members of the machine. An electric motor, indicated 88, transmits drive to a toothed pinion 91 through a toothed belt 89 and a bevel gearing 90. The pinion 91 is connected by a transmission chain 92 to a pinion 93 associated with the drive shaft 70 for the first pivotable plate 64, to a toothed pinion 94 associated with the intermittent rotation mechanism of the rotor shaft 12, to a toothed pinion 95 keyed onto the drive shaft 75 of the second pivotable plate 72, and to a pinion 96 which is coaxial with the pinion 95 and is connected by a first auxiliary transmission chain 97, a jogger 98, and a second auxiliary transmission chain 99, to the splined shaft 56 for driving the itermittent advance of the chains 46. During operation of the machine, after the distances between the angle sections 40 and between the bars 54 have been adjusted in relation to the dimensions of the double-plinth box to be produced, the punched sheets 22 already described are supplied in a pack to the store 20, while the punched sheets 44, which have peripheral flaps **44*a* folded and glued onto the punched sheets themselves, are supplied to the auxiliary store 28**.

During the forming of the box by the mould 28, with the rotor 14 stopped, the first late 64 moves upwardly, takes up an auxiliary punched sheet 44 by means of the suction members 71, and deposits it on the support and guide bars 54. While the rotor 14 rotates through 90° to carry the formed box from the station B to the lower waiting station C, the splined shaft 56 advances the chains 46 by means of the toothed pinions 50 and causes the translational movement of the auxiliary sheet 44 on the guide bars 54 beneath the glue supply head 82, by means of the stop teeth 62. During the movement of the sheet 44 beneath the head 82, the pneumatic piston 86 supplies, in synchronism, a dose of liquid glue to the nozzles 83 the closure of which is controlled by the pneumatic solenoid valve 87; if the shutters associated with the solenoid valve 87 close the nozzles 83 before the end of the delivery from the pneumatic piston 86, a vent valve (not illustrated) recycles the heat-fusible glue to the reservoir 85. This enables very accurate metering of the glue in the form of strips S (FIG. 8) onto the punched sheet 44.

When a partially-finished box 33 (FIG. 8) is at the lower waiting station C with the base portion 22*a* facing the second plate 72, this plate takes the punched sheet 44 from the guide bars 54 and brings it into contact with the bottom part 22*a* of the box 23. During this contact, which, as already stated, is prolonged by virtue of the presence of the springs 82 associated with the auxiliary rods 76, the auxiliary sheet 44 is glued to the semi-finished box 23, making a double-plinth box 100 as illustrated in FIG. 7.

In order to avoid slippage of the auxiliary punched sheet 44 upon stoppage of the chains 46 due to its inertia on the guides 54, it is advantageous to provide a stop 101 in correspondence with the plane defined by the upper passes of the chains 46, which enables the auxiliary punched sheets 44 to be positioned correctly at the lower waiting station C.

With regard to the synchronisation of the connection of the suction members 71 to a vacuum source V relative to the supply of liquid glue, there are keyed onto the shaft 70 cams 102 and 103 associated with respective microswitches 102*a* and 103*a* and a cam 104 associated with a respective valve for the connection to the vacuum source V. The microswitch 102*a* is connected to a pneumatic solenoid valve 102*b* for the pneumatic control of the piston 86, while the microswitch 103*a* is connected toa pneumatic solenoid valve 87 assoicated with the nozzles 83. The cam 104 interrupts the suction to the member 71 at a suitable moment to enable the release of the auxiliary punched sheets 44 onto the respective guides 54.

Moreover, for safe and reliable operation, the machine has a first photocell 105 (FIG. 6) for providing a signal indicative of the presence of a punched sheet 22 at the forming station B, and a second photocell 106 for detecting the presence of an auxiliary sheet 44 on the chains 46. It is clear that the supply of glue is prevented both by the lack of a sheet 22 on the forming head 16 and the lack of an auxiliary sheet 44 beneath the glue supply nozzles 83.

It is understood that, the principle of the invention remaining the same, the constructional details and forms of embodiment may be varied widely with respect to that described and illustrated in the drawings, without thereby departing from the scope of the invention.

For example, the machine is adapted to the formation of double-plinth boxes of cardboard, rigid laminated plastics or like materials, having side walls with a polygonal plan and a bottom ad a lid of various but identical shapes.

I claim:

1. An automatic machine for forming boxes having a bottom, a lid opposite the bottom and hinged thereto, and side walls extending between the bottom and the lid, including a cross-shaped rotor rotatable about a horizontal axis, at least four forming heads carried by the rotor and movable successively, as a result of the rotation of the rotor, between an upper station for the supply of punched sheets of cardboard and the application of a liquid glue to predetermined zones of the sheets, a front station for forming the containers by cooperation of the heads with an erection mould, a lower waitng station, and a rear station for discharge of the boxes, and suction members provided on the forming heads, wherein the supply station is adapted to receive punched sheets shaped so as to define the bottom, the side walls, the lid and a first plinth associated with the lid, and wherein the machine further includes a store for the supply of auxiliary cardboard sheets for constituting a second plinth of the box associated with the bottom of the latter, and actuator means for selectively taking up an auxiliary sheet form the store, applying a predetermined quantity of liquid glue to one face thereof, and subsequently for bringing the auxiliary sheet into contact with the bottom of a formed box carried by one of the forming heads at the lower waiting station in order to join them by gluing; said acutator means comprising:

stepwise conveyor means located beneath the rotor, between the store disposed in front of the machine and the lower waiting station;

take-up means located beneath the store and provided with suction members for taking an auxiliary sheet selectively from the store and transferring it to the conveyor means;

liquid glue supply means associated with the conveyor means and arranged to deposit the glue on the auxiliary sheet; and lifting means located beneath the lower waiting station and arranged to take the auxiliary sheet from the conveyor means and bring it into contact with the bottom with the formed box carried by the forming head.

2. A machine according to claim 1, wherein the take-up means and the lifting means comprise first and second plates which can be reciporcated vertically, and wherein respective connecting rod and crank systems are provided for reciprocating the plates.

3. A machine according to claim 1, wherein the conveyor means include a pair of endless chains disposed parallel to each other and provided with engagement teeth which face each other, respective toothed pulleys over which the chains pass, and a chain drive shaft rotated intermittently substantially in synchronism with the rotor of the machine.

4. A machine according to claim 1, wherein the glue supply means comprise a plurality of nozzles located between the store and the lower waiting station of the rotor so as to be able to supply strips of glue to the auxiliary sheets during their movement on the conveyor means.

5. A machine according to claim 2, wherein resilient means are itnerposed between the second plate and the connecting rod of the lifting means and are arranged to prolong the duration of the contact between the auxiliary sheet carried by the second plate and the bottom of the box carried by the rotor.

6. A machine according to claim 5, wherein one end of the connecting rod associated with the lifting means is connected to an auxiliary plate having guide rods beneath it which are slidable vertically in suitable bushes fixed to the structure of the machine, the second plate has support rods fixed thereto and slidable in the auxiliary plate, and helical springs coaxial with the support rod are interposed between the second plate and the auxiliary plate.

7. A machine according to claim 2, wherein the first plate of the take-up means has guide rod slidable vertically in suitable bushes fixed to the structure of the machine.

8. A machine according to claim 1, wherein the liquid glue supply means have an associated sensor for providing a signal indicative of the presence of the auxiliary sheet on the conveyor means, so as to provide the supply means with an enabling signal for the supply of glue.

9. A machine according to claim 3, wherein screw-and-nut means are associated with the parallel chains for adjusting their spacing.

* * * * *